US005438744A

United States Patent [19]

Horikawa et al.

[11] Patent Number: 5,438,744

[45] Date of Patent: Aug. 8, 1995

[54] AUTOMATIC FINISHING METHOD FOR AIRTIGHT AND WATERPROOF SLIDE FASTENER

[75] Inventors: Yoichi Horikawa; Tsutomu Hakoi, both of Toyama, Japan

[73] Assignee: Yoshida Kogyo K.K., Tokyo, Japan

[21] Appl. No.: 113,901

[22] Filed: Aug. 31, 1993

[30] Foreign Application Priority Data

Aug. 31, 1992 [JP] Japan ..... 4-273348

[51] Int. Cl.[6] ..... B21D 53/50

[52] U.S. Cl. ..... 29/408; 29/768; 83/921

[58] Field of Search ..... 29/408, 409, 766, 768, 29/33.2; 83/921

[56] References Cited

U.S. PATENT DOCUMENTS 2,287,263 6/1942 Nedal ..... 29/768
4,237,604 12/1980 Sawada et al. ..... 29/766
4,292,733 10/1981 Iimura ..... 29/766
4,392,291 7/1983 Iai ..... 29/766

FOREIGN PATENT DOCUMENTS 0114672 8/1984 European Pat. Off. .
2423998 11/1979 France .

*Primary Examiner*—P. W. Echols
*Attorney, Agent, or Firm*—Hill, Steadman & Simpson

[57] ABSTRACT

An automatic finishing method for an airtight and waterproof slide fastener, comprising the steps of: supplying each of a pair of slide fastener chains, which has coupling elements attached to a waterproof fastener tape by clamp elements, by a pair of toothed supply rollers meshing with the clamp elements of the respective slide fastener chain; and threading the slide fastener chains through a slider situated on a travelling path of the slide fastener chains for interengaging the slide fastener chains and then discharging the interengaged slide fastener chains from the slider.

5 Claims, 6 Drawing Sheets

AUTOMATIC FINISHING METHOD FOR AIRTIGHT AND WATERPROOF SLIDE FASTENER

BACKGROUND OF THE INVENTION

1. Field of the Invention

This invention relates to an automatic finishing method for an airtight and waterproof slide fastener, and more particularly to such automatic finishing method in which a pair of slide fastener chains is continuously threaded through a slider mechanically.

2. Description of the Related Art

In conventional airtight and waterproof slide fasteners, since confronting longitudinal edges of a pair of fastener tapes made of an elastomeric watertight material such as of rubber or soft synthetic resin are forced against each other to produce a sealing effect as closed by a slider, the frictional resistance by the closing and opening action of the slider would be great so that the fastener tapes tend to be damaged if they are moved as held by grippers or are conveyed by feed rollers like the conventional slider attaching apparatus. Consequently it has been a common practice to thread a slider onto a pair of airtight and waterproof slide fastener chains manually.

Such manual slider threading would reduce the rate of production, and therefore an automatic slider mounting apparatus, which enables the whole finishing process to be fully automatic, has long been cherished.

SUMMARY OF THE INVENTION

It is an object of this invention to provide an automatic finishing method, for an airtight and waterproof slide fastener, in which a pair of slide fastener chains is threaded through a slider automatically in such a manner that opposed fastener tapes can be conveyed without being damaged.

According to the invention, there is provided an automatic finishing method for an airtight and waterproof slide fastener, comprising the steps of: supplying each of a pair of slide fastener chains, which has coupling elements attached to a waterproof fastener tape by clamp elements, by a pair of toothed supply rollers meshing with the clamp elements of the respective slide fastener chain; and threading the slide fastener chains through a slider situated on a travelling path of the slide fastener chains for interengaging the slide fastener chains and then discharging the interengaged slide fastener chains from the slider.

Preferably, the pair of toothed supply rollers are spaced apart from each other by a distance larger than the length of each of successive space portions formed in the individual slide fastener chain.

Further, the individual slide fastener chain is cut between the pair of toothed supply rollers.

Furthermore, the upstream one of the pair of toothed supply rollers is intermittently moved apart from the individual slide fastener chain to allow successive top end stops mounted on the individual slide fastener chain to pass.

DETAILED DESCRIPTION

One embodiment of this invention will now be described with reference to the accompanying drawings.

Figure 1:
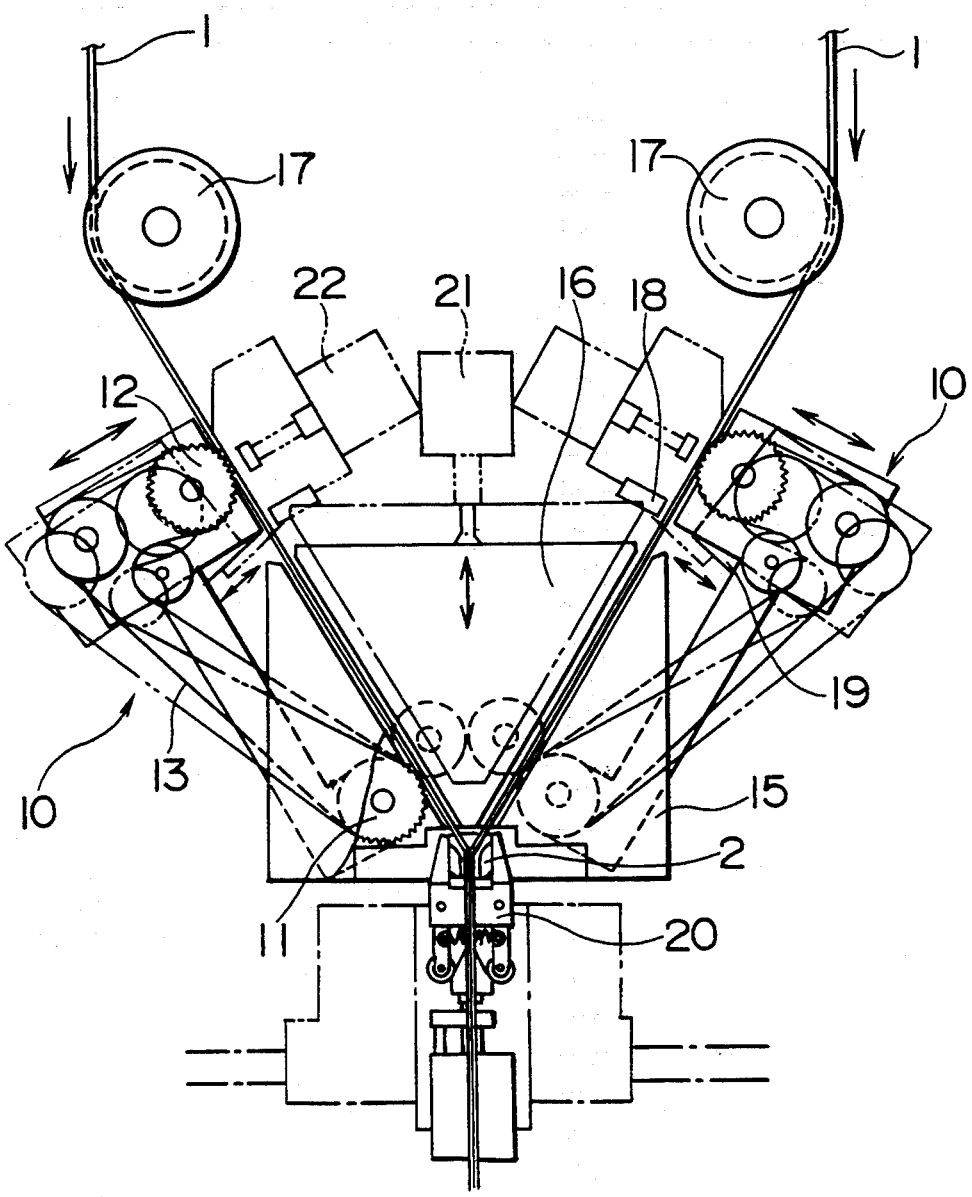
FIG. 1 is a schematic plan view with a part broken away, of an airtight and waterproof slide fastener finishing apparatus for carrying out this invention.

FIG. 1 schematically shows an apparatus for carrying out an automatic finishing method, for an airtight and waterproof slide fastener, according to this invention.

Figure 5:
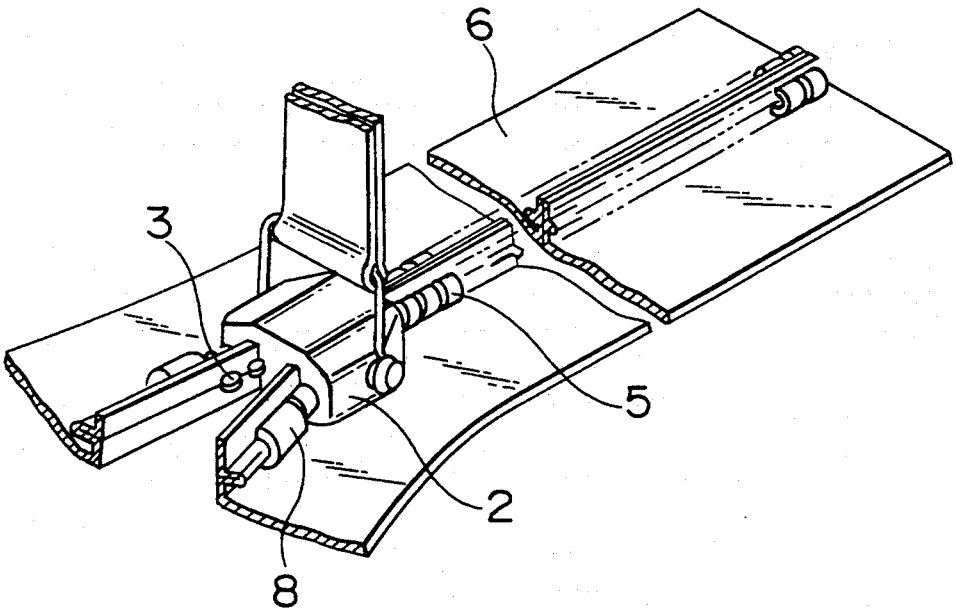
FIG. 5 is a perspective view of a finished airtight and waterproof slide fastener, with a slider mounted on the opposed chains.
Figure 6:
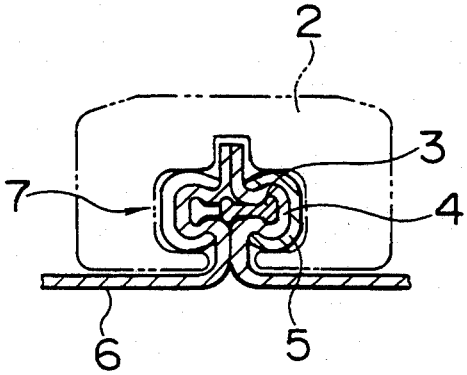
FIG. 6 is a cross-sectional view showing the manner in which fastener elements of the airtight and waterproof slide fastener are interengaged.

Reference numeral 1 designates each of a pair of continuous airtight and waterproof slide fastener chains (hereinafter called "chains") Which is initially separate from each other and is then to be threaded through a slider 2 for interengagement. In each chain 1, as shown in FIGS. 5 and 6, a succession of airtight and waterproof fastener elements 7 are mounted on and along a longitudinal edge of a fastener tape 6 and includes coupling elements 3 partly wrapped by a holding portion 4 extending along the longitudinal tape edge, and clamp elements 5 fixedly securing the holding portion 4 to and around the coupling elements 3. The opposed chains 1, 1 are respectively conveyed to the slider 2 by a pair of conveyer units 10 as guided by a pair of guide rollers 17.

Figure 4:
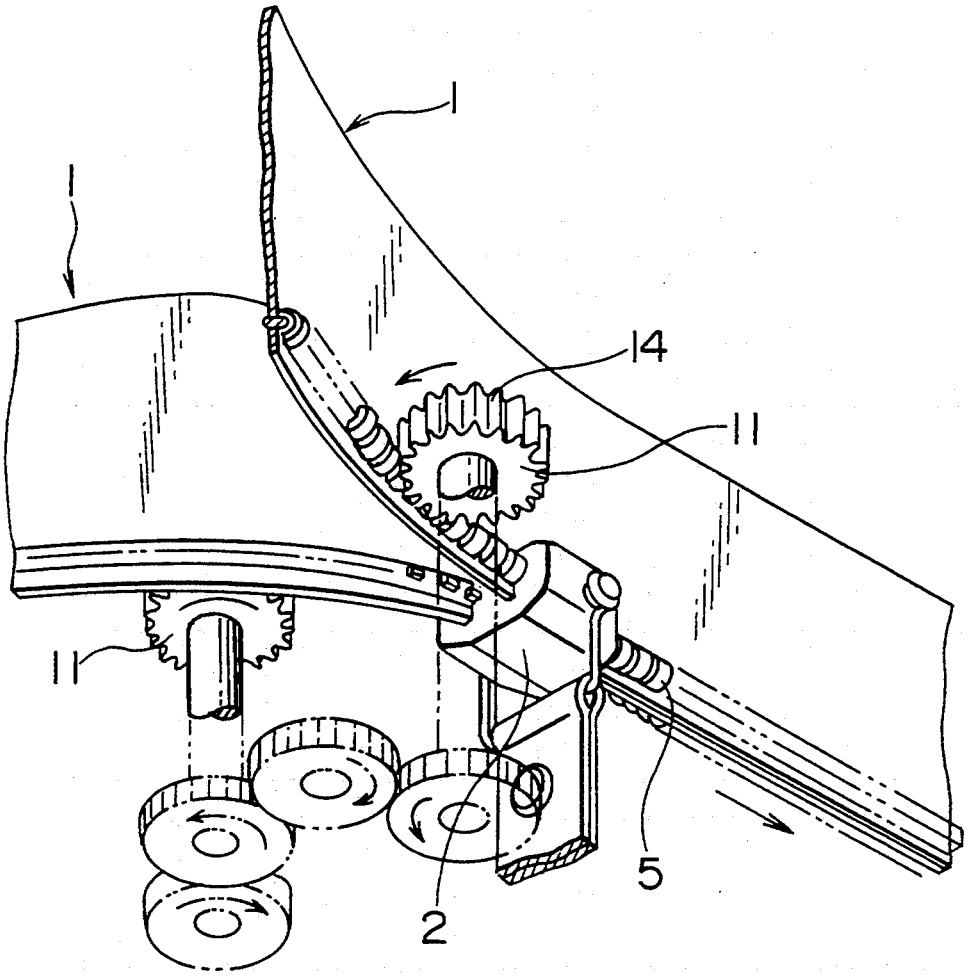
FIG. 4 is a perspective view showing the manner in which the opposed chains are to be conveyed by the first supply rollers.

Each of the conveyer units 10 includes, as shown in FIG. 1, a pair of supply rollers 11, 12 situated downstream and upstream of a traveling path of the chain 1. The first supply roller 11 on the downstream side is driven by a servo motor and is operatively connected with the second supply roller 12 on the upstream side by a timing belt 13 for synchronous rotation. As shown in FIG. 4, each of the supply rollers 11, 12 has peripheral teeth 14 for meshing with the clamp elements 5 of the fastener elements 7 mounted on the longitudinal edge of the fastener tape 6 of the chain 1 to move the chain 1. Therefore, even when a great force is exerted on the slider 2 whose frictional resistance is great, not only the fastener tape 6, which is made of an elastomeric watertight material such as rubber, but also the coupling elements 3 will be free from any damage. Along the traveling paths of the opposed chains to be conveyed by the first supply rollers 11 and the second supply rollers 12, a pair of outer chain guides 15 and an inner chain guide 16 are situated. The first and second supply rollers 11, 12 are spaced apart from each other by a distance larger than the length of a space portion 9, devoid of fastener elements 7, of the chain 1 so that at least one of the first and second supply rollers 11, 12 will mesh with the chain 1 while the space portion 9 passes. The second supply roller 12 is angularly movable outwardly about the shaft of the first supply roller 11 along an arcuate locus from the solid-line position to the phantom-line position in FIGS. 1 and 2 to come out of meshing engagement with the chain 1 so that a top end stop 8 attached to the chain 1 will be allowed to pass without obstruction.

Figure 3:
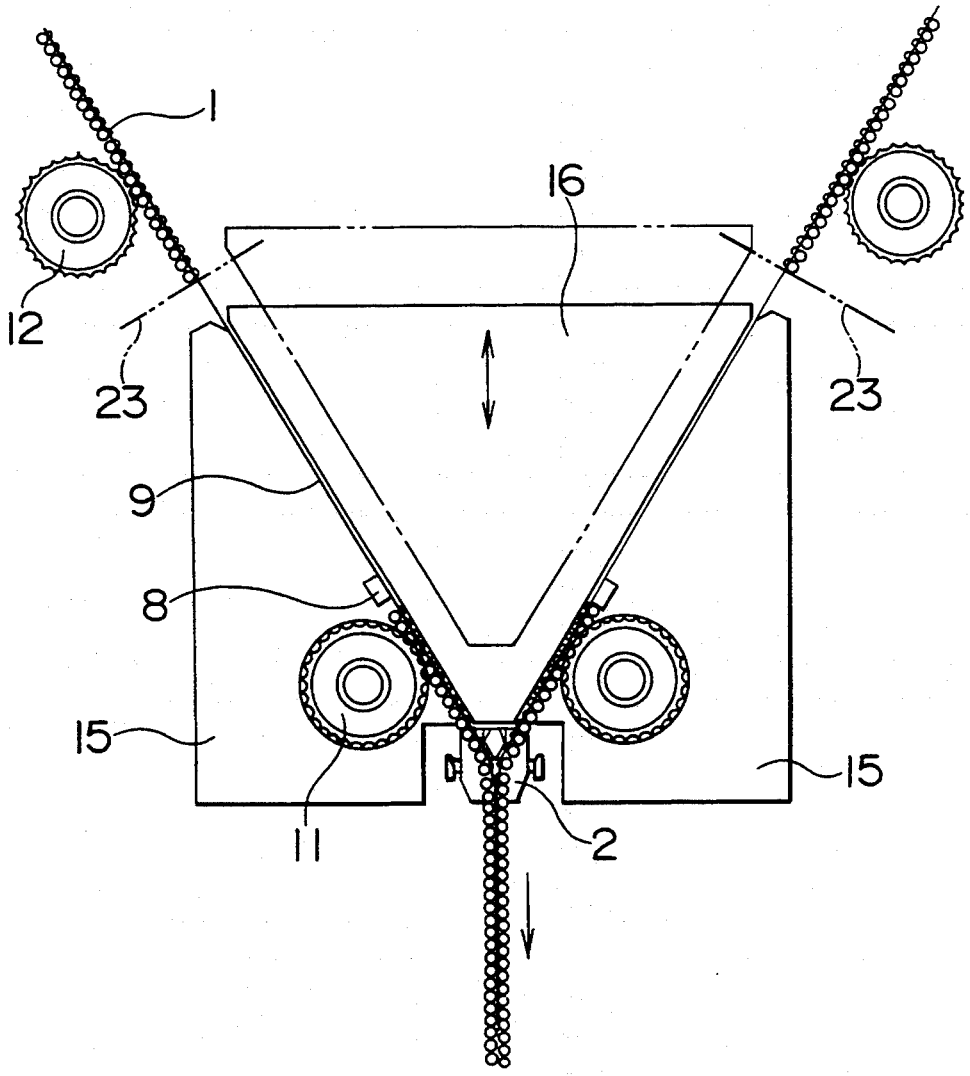
FIG. 3 shows the manner in which each of the opposed chains are to be cut at a position between the first and second supply rollers.

Downstream of each second supply roller 12, a cutting unit is situated as shown in FIG. 1; when a predetermined length of the chain 1 has been measured by the drive motor for the first supply roller 11, the drive motor issues a command to activate an outer cutter blade 19 with respect to a fixed inner cutter blade 18 to cut the chain 1 along a cutting line 23 shown in FIG. 3.

The opposed chains 1, 1 meet at a standby position to which the sliders 2 are supplied one at a time from a slider feeder successively. At the standby position, while the slider 2 supplied is held by a slider supply gripper 20, the opposed chains 1, 1 are threaded through the slider 2 from its front end and then are discharged from its rear end as an interengaged pair. Then the gripper 20 releases the slider 2 before a pair of top end stops 8 of the respective chains 1, 1 reaches the standby position so that the interengaged chains 1, 1 with the slider 2 mounted thereon will be discharged as a finished slide fastener shown in FIG. 5. The inner chain guide 16, which is sandwiched between both of the outer chain guides 15, 15, is retractable by, for example, a pressure cylinder 21 from the solid-line position to the phantom-line position as shown in FIGS. 1 and 3 to facilitate the discharge of the product.

Both of the conveyer units 10 are of the same structure and are situated in symmetry, but the respective corresponding supply rollers of these conveyer units 10 are displaced with respect to each other by a half pitch in order to mesh with the respective rows of fastener elements 7, which are displaced with respect to each other by a half pitch.

Figure 2:
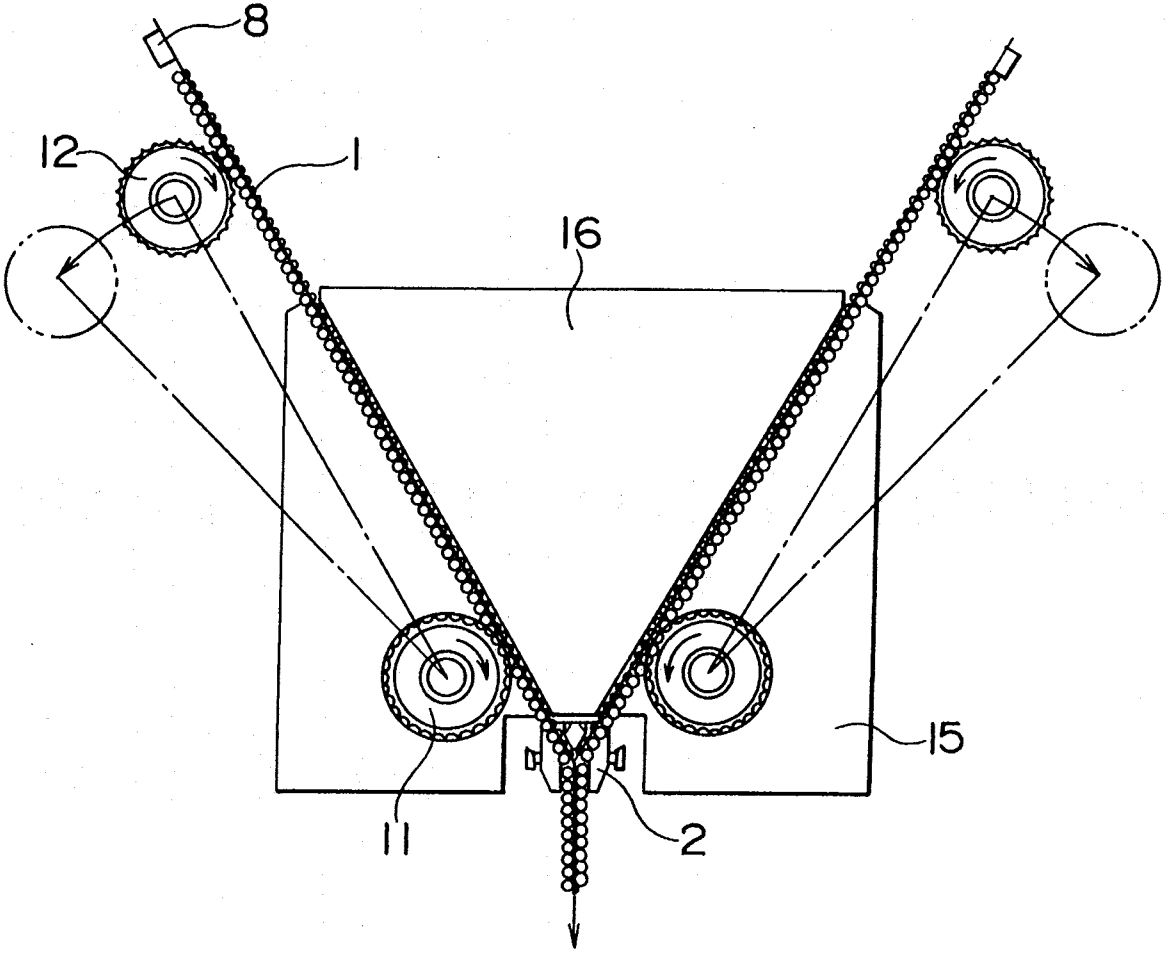
FIG. 2 shows the manner in which the opposed chains are to be conveyed each by first and second supply rollers.

The slider attaching steps of the automatic finishing method will now be described. The opposed chains 1, 1 to which the fastener elements and the top end stop 8 are mounted in the previous step are separated from each other and are supplied to the respective conveyer units 10. The opposed chains 1, 1 are then inserted through the slider 2, which is in the standby position, from its front end via the chain travelling path defined by the outer chain guides 15 and the inner chain guide 16 as the first supply roller 11 and the second supply roller 12 mesh with the clamp elements 5 of the individual chain 1 as shown in FIGS. 2 and 4. From the rear end of the slider 2, the opposed chains 1, 1 as an interengaged pair are discharged toward a subsequent step. Upon detection of approach of a top end stop 8 mounted on the chain 1, the second supply roller 12 will be actuated by, for example, the pressure cylinder 22 to move angularly about the first supply roller 11 along an arcuate locus outwardly from the solid-line position to the phantom-line position as shown in FIGS. 1 and 2, thus facilitating the passage of the top end stop 8. Then the space portion 9, which is devoid of the fastener elements 7 and is formed in the chain 1, passes the second supply roller 12. During that time, since the first supply roller 11 meshes with the clamp elements 5 of the chain 1, there is no hindrance to the feed of the chain 1. When a cutting position of the chain 1 is detected by counting encoder pulses of the servo motor, which is the drive source for the first supply roller 11, the first and second supply rollers 11, 12 will be stopped, whereupon the outer cutter blade 19 is activated with respect to the inner cutter blade 18 by a pressure cylinder to cut the chain 1 along a cutting line 23 of FIG. 3, i.e. at a position slightly downstream of the second supply roller 12, thus severing a predetermined length off the chain 1. Upon completion of the cutting, the inner chain guide 16 will be retracted, by the action of the pressure cylinder 21, from the solid-line position to the phantom-line position, as shown in FIGS. 1 and 3, to widen the chain travelling path so that the trailing end of the chain 1 can pass smoothly when the interengaged chains 1, 1 with the slider 2 released from the supply gripper 20 is discharged as a product as then gripped by a discharge gripper. Upon termination of discharge of a predetermined length of the finished chains with the slider 2 mounted thereon, the first and second supply rollers 11, 12 will restart rotating to convey the succeeding chain 1 as the second supply roller 12 meshes with the leading end of the chain 1 as shown in FIG. 3. When the leading end of the chain 1 reaches the first supply roller 11 via the chain travelling path defined between the inner chain guide 16 returned to the original position and the outer chain guides 15, the first supply roller 11 comes into meshing engagement with the leading end of the chain to lead the chain 1 into the slider 2. Thus as the foregoing steps are repeated, successive sliders are automatically attached one at a time to the continuous chains 1, 1, and a predetermined length is severed off the continuous chains 1, 1 at a time; the resulting successive finished chains 1, 1 are discharged as slide fasteners.

In the illustrated embodiment, the chains 1, 1 to be processed are those on which top end stops are mounted and in which space portions are formed. Alternatively, the chains 1, 1 to be threaded through a slider may be free of any top end stop or any space portion; in such event, it is unnecessary to move the second supply roller 12 away from the chains.

Figure 7:
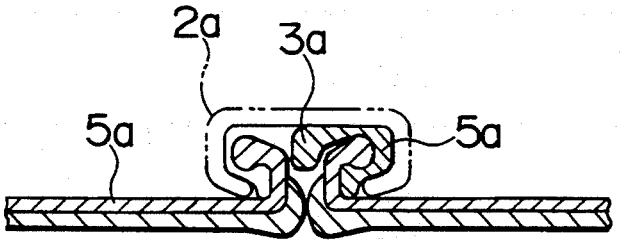
FIG. 7 is a cross-sectional view showing the manner in which modified fastener elements each having a clamp element integral-therewith are interengaged.

Further, in this embodiment, the coupling elements 3 and the clamp elements 5 are independent of each other as shown in FIG. 6. Alternatively, as shown in FIG. 7, the individual fastener element mounted on the chain may be in a unitary form integrally composed of a coupling element 3*a* and a clamp element 5*a*.

In the method of this invention, since the chains are conveyed as the toothed supply rollers mesh with the clamp elements mounted on the waterproof fastener tapes, it is possible to convey the chains by a strong force without damaging the waterproof faster tapes, which are made of an elastomeric watertight material such as rubber, or the fastener elements. According to this invention, it is successful to automatize the slider attaching operation, in which the individual slider can be automatically threaded on the airtight and waterproof chains, so that the finishing process for airtight and waterproof slide fasteners can be made fully automatic, thus improving the rate of production remarkably.

Since the distance between the first and second toothed supply rollers is larger than the length of the individual space portion, at least one of the first and second supply rollers will mesh with the clamp elements while the individual space portion devoid of clamp elements passes.

Further, since the chain is cut at a position between the first and second toothed supply rollers, the leading end of the succeeding chain after cutting meshes with the first supply roller so that the succeeding chain can be conveyed without hindrance.

Furthermore, since the second supply roller is movable outwardly away from the chain travelling path when a top,end stop mounted on the chain passes, the teeth of the second supply roller are free from any damage.

What is claimed is:

1. An automatic finishing method for an airtight and waterproof slide fastener, comprising the steps of:

(a) supplying each of a pair of slide fastener chains, which has coupling elements attached to a waterproof fastener tape by clamp elements, by a pair of toothed supply rollers meshing with the clamp elements of the respective slide fastener chain; and (b) threading the slide fastener chains through a slider situated on a travelling path of the slide fastener chains for interengaging the slide fastener chains and then discharging the interengaged slide fastener chains from the slider.

2. An automatic finishing method for an airtight and waterproof slide fastener according to claim 1, wherein the pair of toothed supply rollers are spaced apart from each other by a distance larger than the length of each of space portions formed in the individual slide fastener chain.

3. An automatic finishing method for an airtight and waterproof slide fastener according to claim 2, wherein the individual slide fastener chain is cut at a position between the pair of toothed supply rollers.

4. An automatic finishing method for an airtight and waterproof slide fastener according to claim 2, wherein the upstream one of the pair of toothed supply rollers is intermittently movable apart from the individual slide fastener chain to allow successive top end stops mounted on the individual slide fastener chain to pass.

5. An automatic finishing method for an airtight and waterproof slide fastener according to claim 3, wherein the upstream one of the pair of toothed supply rollers is intermittently movable apart from the individual slide fastener chain to allow successive top end stops mounted on the individual slide fastener chain to pass.

* * * * *